US005941529A

United States Patent [19]

Kinsey

[11] Patent Number: 5,941,529

[45] Date of Patent: Aug. 24, 1999

[54] SAUCER TARGET

[76] Inventor: James M. Kinsey, 10619 Pine Mills Rd., Fort Wayne, Ind. 46845

[21] Appl. No.: 08/960,304

[22] Filed: Oct. 29, 1997

[51] Int. Cl.[6] ..... A63B 63/00

[52] U.S. Cl. ..... 273/401

[58] Field of Search ..... 273/398, 400, 273/401, 402; 473/476, 478, 470, 471, 197, 454, 455, 462

[56] References Cited

U.S. PATENT DOCUMENTS

| | | |
|---|---|---|
| 469,554 | 2/1892 | Favor . |
| 3,575,415 | 4/1971 | Fulp et al. . |
| 3,580,578 | 5/1971 | McCarthy . |
| 3,802,703 | 4/1974 | Van Tassel . |
| 3,822,883 | 7/1974 | De Vos . |
| 4,373,734 | 2/1983 | Frank . |
| 4,461,484 | 7/1984 | Headrick . |
| 4,796,886 | 1/1989 | Loh . |
| 5,000,461 | 3/1991 | Borazjani . |
| 5,358,255 | 10/1994 | Jolson . |

*Primary Examiner*—William H. Grieb
*Attorney, Agent, or Firm*—Lundy and Associates

[57] ABSTRACT

A new and improved saucer target comprising a frame and a cover which is supported on the frame having a generally open front. The cover extends rearwardly of the front, closing the sides and the back of the frame. The cover has at least one generally horizontal shelf extending away from the front toward the back of the frame defining a plurality of pockets having an open front and closed top and bottom and sides and back extending rearwardly from the open front. The cover is made of supported fabric whereby each pocket is provided with an opening larger than the diameter of a saucer in all horizontal dimensions, and resilient sides and back and top and bottom which when impacted by a saucer will absorb the energy of the saucer and decrease its velocity to zero and a bottom which will collect the saucers thrown into the pocket.

30 Claims, 3 Drawing Sheets

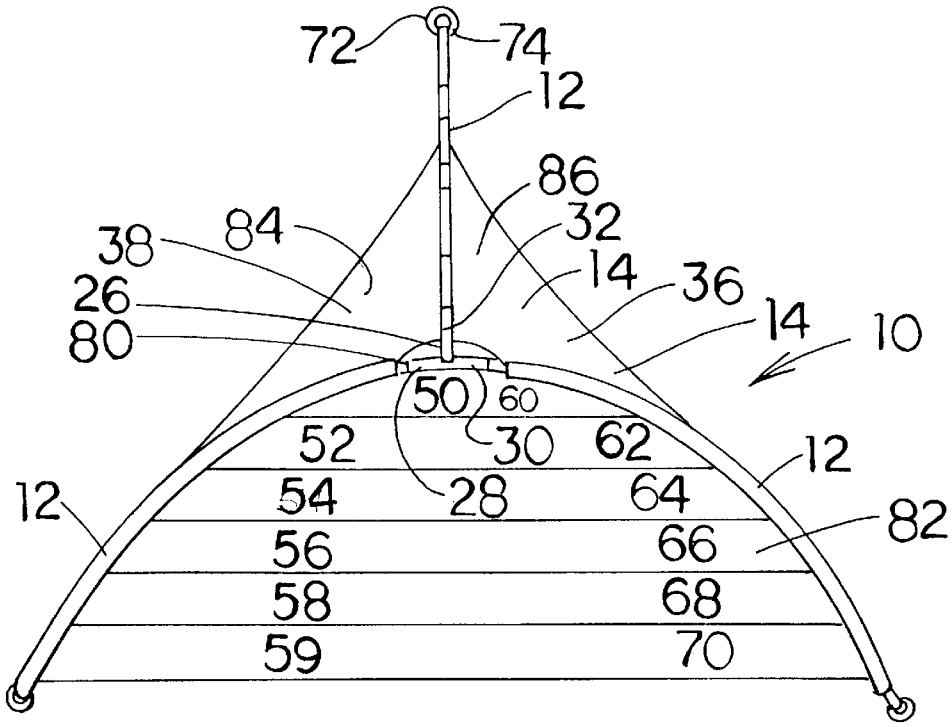
FIG. 5
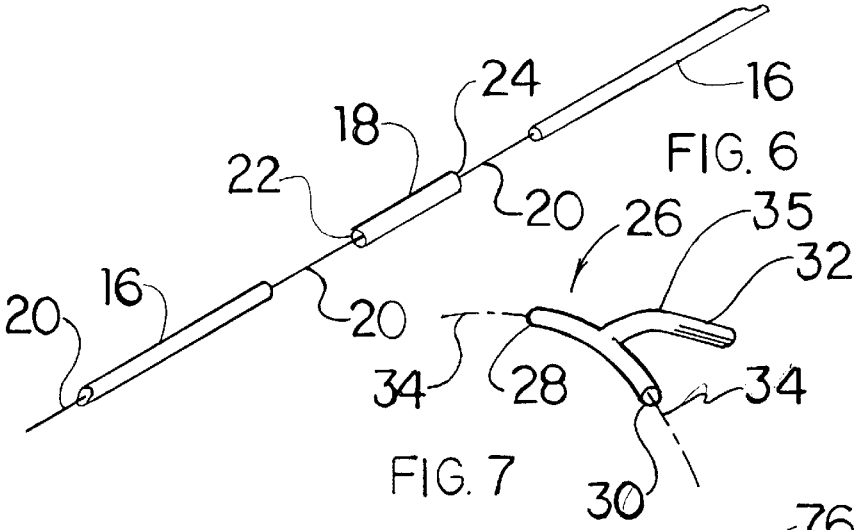
FIG. 6
FIG. 7
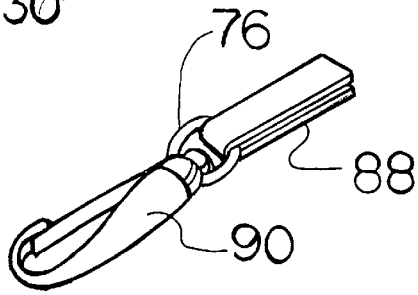
FIG. 8

SAUCER TARGET

BACKGROUND OF THE INVENTION

The present invention relates to a saucer target, more particularly to a new and improved target for a saucer-throwing game which engages players of age six and older.

Both saucers and throwing games have existed for many years. In recent times few families or other groups of persons of multiple ages go to the park, the beach, or to the lake cottage without a saucer. People of all ages enjoy throwing saucers. Although, the enjoyment stems from the recognition of the skill it takes to throw a saucer, to aim a saucer and the fun derived from watching a saucer sail through the air, there are very few saucer throwing games that have become popular or are currently being marketed.

There are and have been a multitude of throwing games which have been popularized. In fact throwing games in which the missiles thrown range from a ball to horse shoes, to rather sophisticated missiles such as lawn darts or the like. Many of these throwing items have been found to be unsuitable for children ages five to seven and others such as lawn darts have been found to be unsuitable for any range of ages. Therefore, it is highly desirable to provide a new and improved throwing game target. It is also highly desirable to provide a new and improved throwing game target safe for persons of all ages.

Saucers, having been available as throwing objects for a number of years have proven to be entirely safe for persons of all ages because of their relatively soft plastic construction and totally blunt and non-sharpened edges. Thus, it is highly desirable to provide a new and improved throwing game target for use with saucers. It is also highly desirable to provide a new and improved saucer target for a throwing game which will interest players of all ages from age six to older.

Saucer throwing games have been provided traditionally in two forms. The first form includes a target which is laid out on the ground or another generally horizontal playing field. The playing field is marked with various areas into which the saucer is thrown. The second form includes a target in the form of a goal which upstands from the ground and has one or more openings in a front surface thereof which allows a saucer to enter into the interior of the target and be captured. Examples of both of these kinds of targets are disclosed in U.S. Pat. No. 4,373,734. The target of the game disclosed in this patent has openings in the front which are designed to accept a saucer skillfully thrown at the goal. Other saucers thrown at the goal will be rejected by the goal and land on the playing field much like in the games of soccer and basketball.

Each of these targets have proven less than satisfactory. Some of these targets are specifically designed to exclude some of the saucers hitting the target. Successfully scoring utilizing these targets require skills not attainable by persons of young age who can learn to throw a saucer. Others capture any saucer hitting the target within its periphery, but cannot segregate those saucers as to throwing skill, and thus do not keep the interest of older and more skillful players. Thus it is highly desirable to provide a new and improved saucer target for a game which holds the interest of players of the game of all ages capable of throwing saucers. It is also highly desirable to provide a new and improved saucer target for a game having a short learning curve. It is also highly desirable to provide a new and improved saucer target for a game having a simplified scoring scheme based on the skill of the thrower. It is also highly desirable to provide a new and improved saucer target which collects all of the saucers hitting the target, and which segregates the same in accordance with throwing skill. It is also highly desirable to provide a new and improved saucer target which defines the saucer periphery, which absorbs the momentum of a flying saucer within the saucer periphery and decreases its velocity to zero, and which collects those saucers impacting the target in categories segregated for scoring in accordance by throwing skill.

Saucers and targets in order to be highly popular not only must be a kind which must hold the interest of persons of all ages, but must be of the type which can easily be set up and disassembled and stored when not in use, be relatively durable such that it will last for many enjoyable years, and be relatively inexpensive to manufacture and own. It is therefore highly desirable to provide a new and improved saucer target which holds the interest of persons playing the game with the target of all ages capable of throwing saucers. It is also highly desirable to provide a new and improved saucer target which can be easily set up for use and disassembled for storage. It is also highly desirable to provide a new and improved saucer target which can be made relatively durable for many years of use and which can be manufactured relatively inexpensively.

Finally, it is highly desirable to provide a new and improved saucer target having all of the features mentioned above.

SUMMARY OF THE INVENTION

It is therefore an object of the invention to provide a new and improved throwing game target.

It is also an object of the invention to provide a new and improved throwing game target safe for persons of all ages.

It is also an object of the invention to provide a new and improved game target for use with saucers.

It is also an object of the invention to provide a new and improved saucer target for a throwing game which will interest players of all ages from age six and older.

It is also an object of the invention to provide a new and improved saucer target for a game which holds the interest of persons playing the game of all ages capable of throwing saucers.

It is also an object of the invention to provide a new and improved saucer target for a game having a short learning curve.

It is also an object of the invention to provide a new and improved saucer target for a game having a simplified scoring scheme based on the skill of the thrower.

It is also an object of the invention to provide a new and improved saucer target which collects all of the saucers hitting the target, and which segregates the same in accordance with throwing skill.

It is also an object of the invention to provide a new and improved saucer target which defines the saucer periphery, which absorbs the momentum of a flying saucer within the saucer periphery and decreases its velocity to zero, and which collects those saucers impacting the target in categories segregated for scoring in accordance by throwing skill.

It is also an object of the invention to provide a new and improved saucer target which can be easily set up for use and disassembled for storage.

It is also an object of the invention to provide a new and improved saucer target which can be made relatively durable for many years of use and which can be manufactured relatively inexpensively.

Finally, it is an object of the invention to provide a new and improved saucer target having all of the features mentioned above.

In the broader aspects of the invention there is provided a new and improved saucer target which will capture all of the saucers hitting the target. The saucer target of the invention includes (1) a structure defining the periphery of the target by which saucers or disks within the periphery will be captured by the target and saucers without the periphery will not be captured by the target; (2) a structure which when the saucers impact will absorb the momentum of the saucer and drop the velocity to zero causing the saucer to fall gravitationally; and (3) a structure defining a basket or catch basin which collects the saucers captured by the target as a function of the throwing skill of the player. The saucer target comprises a frame and a cover which is supported on the frame having a generally open front. The cover extends rearwardly of the front, closing the sides and the back of the frame. The cover has at least one generally horizontal shelf extending away from the front toward the back of the frame defining a plurality of pockets having an open front and closed top and bottom and sides and back extending rearwardly from the open front. The cover is made of supported fabric whereby each pocket is provided with an opening larger than the diameter of a saucer in all horizontal dimensions, and resilient sides and back and top and bottom which when impacted by a saucer will absorb the energy of the saucer and decrease its velocity to zero and a bottom which will collect the saucers thrown into the pocket. The pockets are arranged such that all saucers hitting the target within the periphery and not captured by a specific pocket, will be captured by the next lowest pocket, thus capturing all saucers hitting the target within the target periphery.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein:

FIG. 5 is a top view of the new and improved saucer target of FIG. 1.

FIG. 6 is a perspective view of the ferrule and rod structure of the foldable rods of the invention.

FIG. 7 is a perspective view of the top connector of the new and improved saucer target of the invention.

FIG. 8 is a perspective view of the rod clips of the invention.

DESCRIPTION OF A SPECIFIC EMBODIMENT

Figure 1:
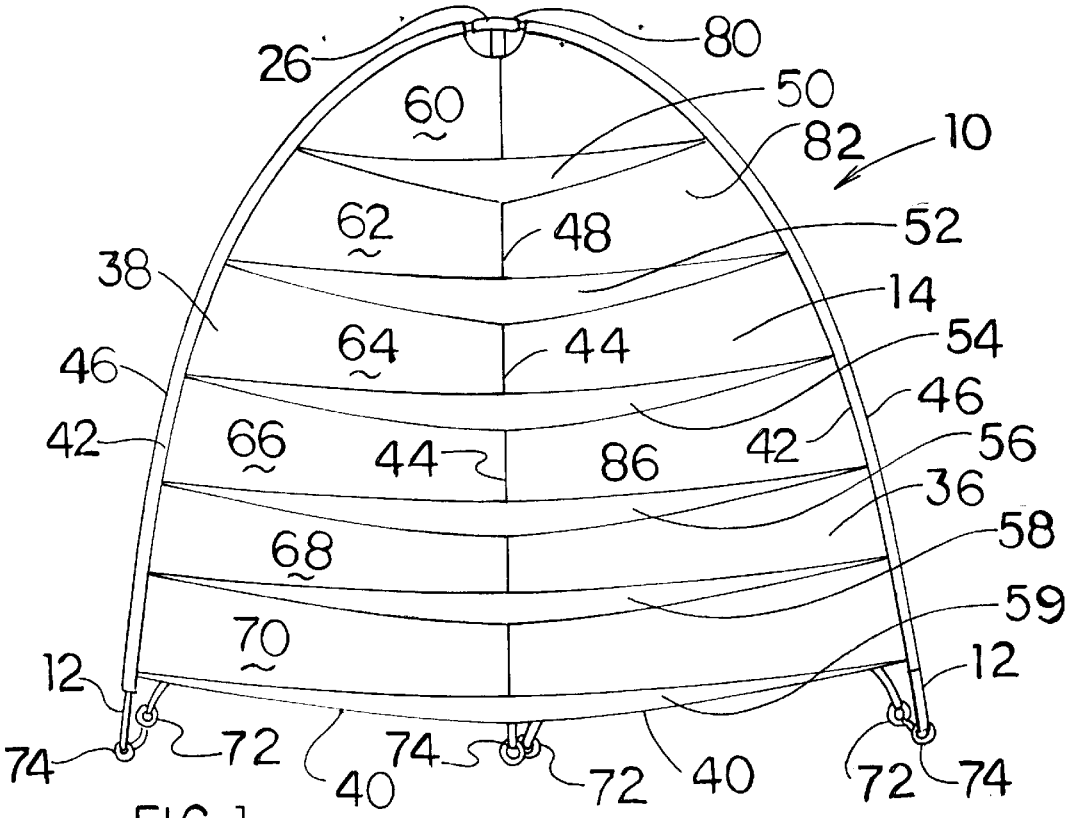
FIG. 1 is a front view of the new and improved saucer target of the invention.
Figure 2:
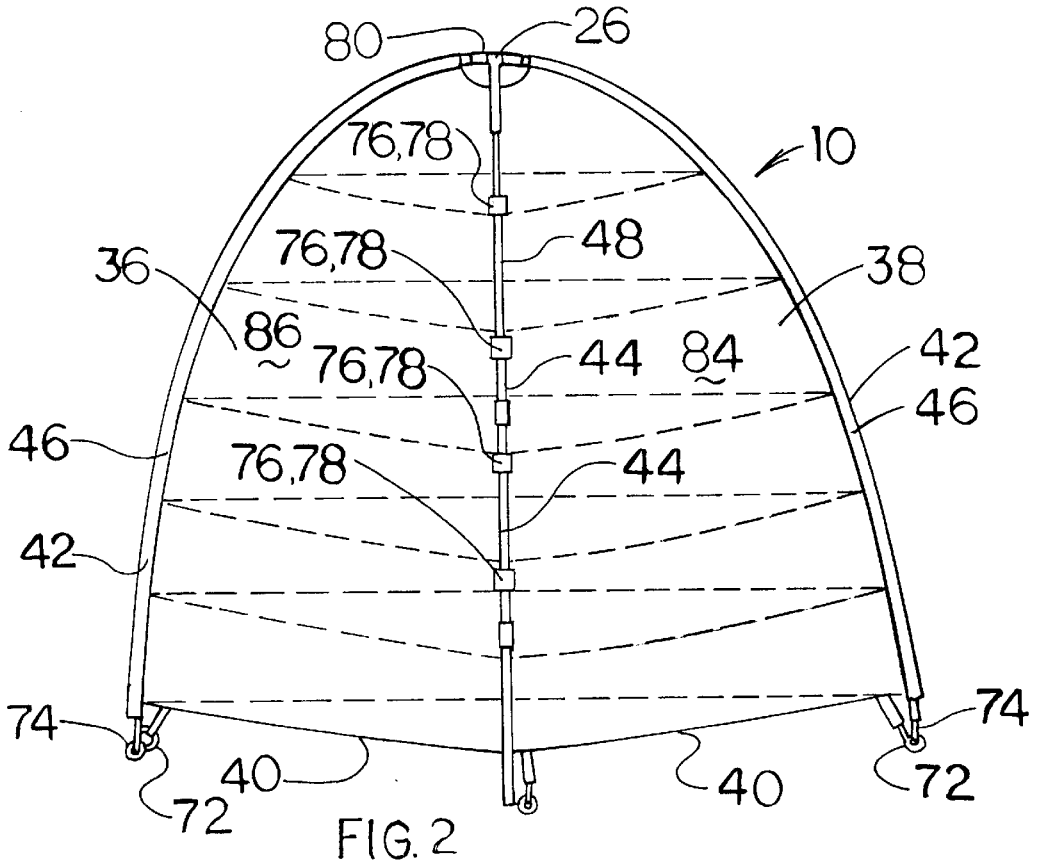
FIG. 2 is a back view of the new and improved saucer target of the invention shown in FIG. 1.

Referring to FIGS. 1 through 5, the new and improved saucer target 10 of the invention is shown to include three flexible and resilient rods 12 and a cover 14. Each of the flexible rods 12 comprise a plurality of segments 16 and a ferrule 18 between adjacent segments 16 to connect the rod segments together into the rods 12.

As shown in the specific embodiment illustrated in FIG. 6, each rod 12 has at least two rod segments 16 and a ferrule 18 between each pair of segments 16. Both the rod segments 16 and ferrule 18 are tubular with the cord 20 extending through the ferrules 18 and rod segments 16 to connect the ferrules 18 and rod segments 16 together as rod units 12. Ferrules 18 have opposite ends 22, 24 which are slightly larger in size and of the same geometric shape of the rod segments 16. The ends of rod segments 16 can thus be frictionally positioned in the opposite ends 22, 24 of ferrule 18 and frictionally secured in an assembled condition. The cord 20 is provided in a length somewhat shorter than the rod segments 16 so as to hold the rod 12 as assembled together. Each of the rods 12 may be broken down into segments 16 and ferrules 18 and stored in a broken down fashion. In a specific embodiment, each of the segments 16 are elongated and have a length which allows the segments 16 to be placed side by side and stored in a box or bag. Each of the rods 12 may be assembled by merely expanding the length of the resilient cord 20 so as to position segment ends into the ferrules therebetween.

In FIG. 7 the rod connector of the invention is shown. Connector 26 has legs 28, 30 and 32 which are each sized and shaped as a ferrule 18. Two of the legs 28 and 30 are on the same curvilinear axis 34 and has a bend 35 therein. The third leg 32 extends generally perpendicularly of axis 34. The distal ends of each of the legs 28, 30, 32 face somewhat downwardly as shown in FIGS. 1 through 5.

One end of the each of the rods 12 are positioned within the distal ends of the legs 28, 30, 32 of rod connector 26 as shown. Connected to the rod connector 26, each of the rods extend axially outwardly from the legs 28, 30 and 32 The rods 12 are held in the shape as shown in FIGS. 1 through 5 by the cover 14. Each of the rods 12 are resiliently bent into the shape illustrated in FIGS. 1 through 5 and assembled on the cover. The resiliency of the rods hold the cover relatively taut in the shape shown.

Cover 14 has opposite fabric sides 36, 38. Both sides 36, 38 are generally triangular having a bottom periphery 40 and upwardly extending side peripheries 42 and 44 joined at the end most distal from bottom periphery 40. Loops 46 are formed at side periphery 44. Loops 46 are shown to be continuous from bottom periphery 40 to the joinder of side peripheries 42 and 44; however, in other specific embodiment s there could be spaced apart loops 46 defining loops 46 or side peripheries 42 and 44 could be connected to rods 12 by rod clips 76 such as hereinafter described.

Sides 36 and 38 are joined at side periphery 44 to form a seam 48. Seam 48 is joined to rear rod 12 as shown in the Figures by a plurality of rod clips 76.

The rod clips 76 clip to the rod 12 and are secured to the fabric at seam 48 by a flexible, non-stretchable tab 88 stitched in seam 48. Flexible tab 88 is attached to a clip 90 which is clipped to rear rod 12. In the specific embodiment illustrated, four rod clips are shown at seam 48 spaced apart and adjacent the bottoms 50, 52 of the top two pockets 60, 62 and adjacent the bottoms 56, 58 of the lower two pockets 68, 70. In other specific embodiments, cover 14 may have fabric loops 46 stitched to seam 48 either in spaced apart portions along its length to define a discontinuous loop 46 in which the rear rod 12 may be positioned, or a continuous loop 46 as above-described with regard to peripheries 42, 44. Rod 12 may be placed within these loops prior to positioning one end in rod connector 32 and pin 74 in the other end which will be described hereinafter.

A plurality of pocket bottoms 50, 52, 54, 56, 58, 59 are secured to sides 36, 38. Pocket bottoms 50 through 59 are of a generally triangular shape but of different size. The smallest pocket bottom 50 is secured by sides 36, 38 most adjacent to the joinder of the side peripheries 42, 44. The largest pocket bottom 59 is joined to the sides 36, 38 most remotely of the joinder of side peripheries 42, 44 and adjacent to bottom peripheries 40 of sides 36, 38. Pocket bottoms 52, 54, 56 and 58 are joined at equal spacing therebetween. Pocket bottoms 50 through 59 when the cover is assembled on the rods 12 as will be described hereinafter are generally parallel to each other, spaced apart and generally horizontal, and generally define pockets 60, 62, 64, 66, 68 and 70.

Cover 14 is made of flexible sheet material. This material may be woven material such as cloth or net material. In other embodiments, the material may be sheet plastic material or cast net material. In other specific embodiments, the cover 14 can be made of any flexible sheet material. The sheet material can be made of solid sheet material as plastic sheet material or woven material. It is preferable, that the material and filaments of any woven material be resistant to deteriorating atmospheres. Further, the material can be tight woven material such as sail cloth or net material having a plurality of adjacent appetures over the entire area of the material of a size less than the size of the saucer being thrown at the target. Material being more porous has an advantage that wind will not blow the target over during play. The sides 36 and 38 are joined to form seam 48 by stitching. The pocket bottoms are joined to the sides 36 and 38 by stitching. In a specific embodiment, the sheet material could be of a thermoplastic material and the seam 48 could be formed and the bottoms could be secured to opposite side 36 and 38 by heat sealing techniques.

The relative positioning between the legs 28, 30 and 32 of connector 26 and the cover 14 provide for both the stability of the target 10 and the support of the cover 14 on the rods 12. The front rods 12 connected to legs 28, 30 of connector 26 are bent arcuately along their length as best shown in FIGS. 1, 2, 4 and 5. In this position, resiliency of rods 12 stretch each of the bottoms 50 through 59 in a horizontal direction between the rods 12 holding each of the bottoms 50 through 59 taut in their generally horizontal position. The fabric of each of the bottoms 50 through 59 hold these rods 12 in their arcuate position and determine the spacing between the rod ends which contact the supporting surface and provide the stability of the target 10 in the side-to-side direction. The specific shape of the rods 12 connected to legs 28, 30 of the rod connector 26 is determined by the side-to-side dimensions of each of the bottoms 50 through 59. In other words, the side-to-side dimensions of each of the bottoms 50 through 59 have a relationship with regard to their spacing by which the rods maintain bottoms 50 through 59 in a fully extended taut condition between the rods 12.

Figure 3:
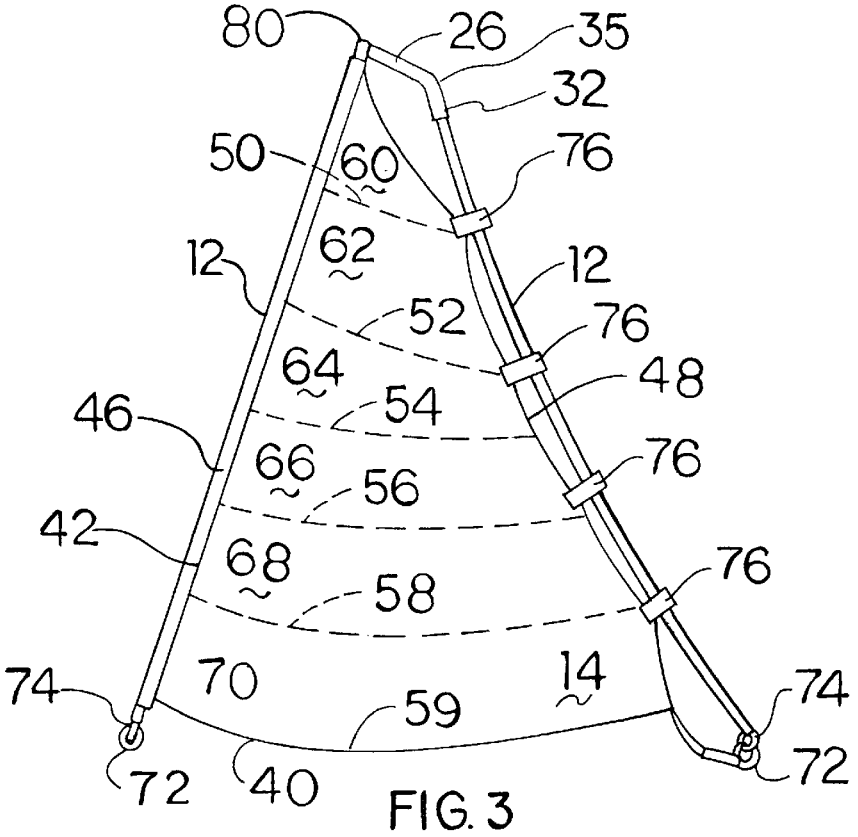
FIG. 3 is a side view of the new and improved saucer target shown in FIG. 1.
Figure 4:
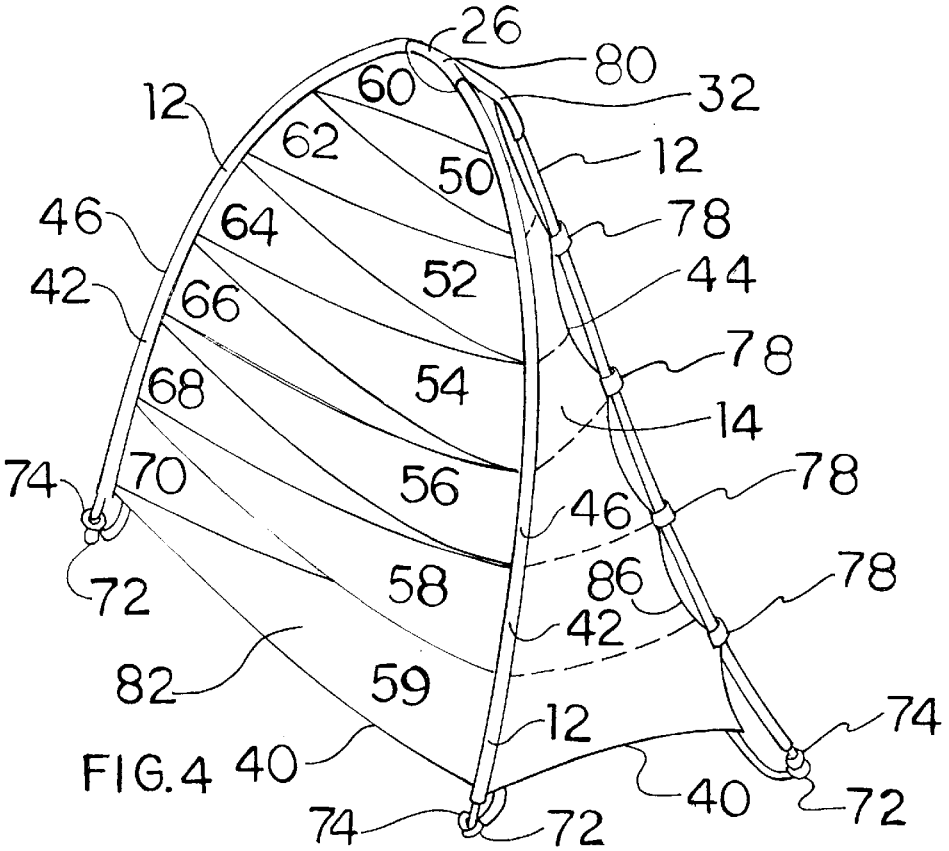
FIG. 4 is a perspective view of the new and improved saucer target of FIG. 1.

Similarly, the third rod 12 connected to end 32 of the rod connector 26 provides both the stability of the target 10 and holds sides 36, 38 in a taut condition and bottoms 50 through 59 in a taut condition front to back. The length of the leg 32 and the position of the bend 35 fully determines both the spacing of this rod 12 from the front two rods 12, and the spacing between the front two rods 12 and the rear rod 12. This spacing is that which provides the stability of the target 10. The spacing of the rear rod 12 from the front two rods 12 by the connector 26 is that which determines the depth of each of the pockets 50 through 59. The resiliency of the rods 12 is that which maintains the bottoms 50 through 59 taut in both the side-to-side direction and the front-to-back direction and the sides 36, 38 taut. As best shown in FIG. 3, the forces exerted by the cover 14 between the front two rods 12 and the rear rod 12 causes the rear rod 12 to be concave in shape and somewhat bent inwardly toward the front two rods 12.

In a specific embodiment, the rods may be of any resilient tubular material. Rod 12 can be made of materials such as wood, all types of metal and extruded plastic materials. The tubular material may have circular cross-sections, or square or rectangular cross-sections as desired. Of course, the cross-sections of the ferrules and the rods must be geometrically similar. The resilient cord 20 may be of any commercially available resilient cord. The length of the resilient cord is shorter than the length of the assembled rods and ferrules in each rod 12. However, the cord must have a length such that the expanded length which is necessary to disassemble or assemble the rods from the ferrules be within the elastic limit of the cord. Similarly, the bending of the rods 12 when the target 10 is erected must also be within the elastic limit of the material of the assembled rods 12. In a specific embodiment, front rods 12 are of equal length. This is accomplished by appropriately dimensioning the legs 28, 30 of connector 26.

Secured to sides 36, 38 at the bottom edge 40 at seam 48 is a ring 72. Similarly a ring 72 is secured to the cover 14 at the bottom edge 40 remote from seam 48 at sides 36, 38. Attached to the rings 72 is a solid rod 74 which is positioned within the bottom rod segments 16 of the rods 12. In this manner, the lower portion of the cover 14 is attached to the rods 12 in its erected condition, and the cover 12 is held in a taut condition top to bottom.

In operation, the target is set up in the location desired. The target may be supported upon a lawn, a driveway, or upon a floating surface above the water.

The target 10 is constructed by constructing each of the rods 12 from the segments 16 and ferrules 18. The cords 20 of each of the rods 12 is resiliently elongated sufficient to place one end of the each of the segments 16 in a ferrule 18. The constructed segments 16 and ferrules 18 form a fully constructed rod 12.

Two of the rods 12 are threaded through the opposite loops 46 at the front of the cover 14 of the target 10. The rods are positioned in the loops such that a rod end extends from the opposite ends of each loop 46. The top one of the rod 12 ends is positioned in legs 28, 30 of rod connector 26. Pins 74 of the opposite cover sides 36, 38 are positioned in the bottom of the rod ends. The remaining rod 12 is positioned in a rod connector leg 32 to depend therefrom in the same general direction as the other rods 12. The positioning and size of bend 35 determines both the spacing of front rods 12 from rear rod 12 and the stability of target 10. The other rods 12 are resiliently bent as shown in the drawings and arched by the fabric of cover 14. As shown in the front and back views of FIG. 1 and of the top view of FIG. 5, these rods are both arched downwardly and forwardly, whereas the remaining and rear rod extends rearwardly of the rod connector 26. The cover 14 is then connected to the rear rod 12 by rod clips 76.

Once constructed, the sides 36, 38 of cover 14 are stretched between rods 12 and the pocket bottoms 50 through 59 are fully extended in a wrinkle-free condition. The target 10 fully constructed as shown in FIGS. 1 through 5 has a generally trapezoidal shape having an apex 80 and three generally depending triangular sides 82, 84, 86 between the rods 12. One of the sides 82 is an open front, the other two sides are closed by the fabric cover 14. The open front side 82 is compartmented into a plurality of pockets 60, 62, 64, 66, 68 and 70. In the specific embodiment illustrated there are six pockets. Each of the pockets are defined by the sides the fabric cover sides 36, 38 and the pocket bottoms 50 through 59. The smallest pocket 60 is adjacent apex 80, the largest pocket 70 defines the bottom.

As best shown in FIG. 5, each of the pockets extend forwardly a distance beyond the next smallest pocket. In this manner, saucers which are not captured by a pocket fall from the forward edge of that pocket's bottom and are captured by a lower pocket. In this manner, all of the saucers thrown at the target which impact the target within the periphery of the target opening 82 are captured by the target except for those which fall from the front lip of the bottom pocket 70.

In a specific embodiment, front rods 12 are each about 6 feet long, rear rod 12 is about 5½ feet long, cover 14 has a bottom periphery 40 of about 6 feet long, front peripheries 42 about 6 feet long, and back peripheries 44 of 6 feet long. Pocket bottom 50 has a front periphery of about 3 feet long and side peripheries of about 2 feet long. Bottom 52 has a front periphery of about 4 feet long and side peripheries of about 2½ feet long. Bottom 54 has a front periphery of about 5 feet long and side peripheries of about 3 feet long. Bottom 56 has a front periphery of about 5½ feet long and side peripheries of about 3½ feet long. Bottom 58 has a front periphery of about 6 feet long and side peripheries of about 4 feet long. Bottom 59 has a front periphery of about 6½ feet long and side peripheries of about 4¼ feet long. Leg 32 of connector 26 is about 8½ inches long and bend 35 is located about 2 inches from its distal end.

In use, a game may be played having enormous popularity among persons of age 6 and older. From one to four persons can play the game. The game is played by throwing saucers from a throwing line of approximately thirty feet from the target. Each of the pockets are assigned different game scores for saucers landing in the pockets. In a specific embodiment, the top pocket is given 100 points score. The bottom pocket is given 10 points score. With each of the pockets in between given progressively 50 points, 40 points, 30 points, 20 points.

Each game player throws four saucers and then retrieves them to count the points received. The first player to accumulate 500 points wins. Contestants receive equal throws, with the previous game winner throwing first. Saucers must be at least one-half inside a pocket bottom to be captured by that pocket. Saucers which are less than one-half in a pocket fall by gravity and are captured by a lower pocket, usually the next lowest pocket. Saucers which go through the pocket openings are impacted by the sides 36, 38. As they are made of fabric and are resilient, the velocity of the saucer is reduced to zero by the side absorbing the impact of the saucer and the saucer falls and collects on the bottoms 50, 52, 54, 56, 58 and 59. Saucers do not enter a pocket and come back out the front opening. Saucers less than one-half inside the bottom pocket 59 fall outside the target by gravity, and are the only saucers which impact target 10 within the periphery of front opening 82 and are not captured by target 10.

Expert players may give younger players or ones playing the game for the first time a handicap by placing a throwing line twenty feet or less from the target. Skilled players may select a throwing line of forty or fifty feet from the target.

Alternatively, each contestant may receive five rounds of four throws each and the highest scores achieved wins. This alternative scoring is preferable when more than four players are playing the game.

The invention provides a new and improved throwing game and a new and improved saucer target which is entirely safe, and which will interest players of all ages. The new and improved game and target holds the interest of persons of all ages capable of throwing saucers. The game has a short learning curve and a simplified scoring scheme with the total score based upon the skill of the thrower. The new and improved saucer target collects all of the saucers hit in the target and segregates them in accordance with throwing skill. The new and improved saucer target can easily be set up for use and disassembled for storage, is relatively durable for many years of use and can be manufactured relatively inexpensively.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto.

What is claimed is:

1. A target comprising a frame, said frame having three resilient and flexible rods having opposite ends, said ends being joined at one of said ends thereby defining the top of said frame, and a frame cover, said frame cover being supported on said frame, said rods being flexed into a shape held by said cover, the resiliency of said rods holding said cover in a taught and expanded condition, said cover having an open front and a closed back, said open front being divided into a plurality of front openings of spaced apart target pockets, each of said pockets having a bottom, a front opening, a closed top, and closed sides, said pockets extending rearwardly of said open front, said pocket openings being larger than the diameter of a throwing saucer in the horizontal direction whereby a game may be played by players throwing saucers at said target and accumulating a score from a plurality of scores associated with each saucer landing in the respective pockets of said target each of which is a function of the skill required of throwing a saucer into the respective pockets.

2. The target of claim 1 wherein said cover is made of flexible sheet material held relatively taut by said frame, said pocket bottoms, top and sides being generally resilient so as to absorb the impact of a saucer and reduce the velocity to zero allowing the saucer to drop gravitationally onto the bottom of the pocket into which said saucer enters.

3. The target of claim 1 wherein said pocket bottoms are generally horizontal.

4. The target of claim 1 wherein said pocket openings generally have the same vertical height and different widths.

5. The target of claim 1 wherein said pockets have different depths.

6. The target of claim 5 wherein said plurality of pockets having an upper-most pocket and a bottom-most pocket, said upper most pocket having the shortest depth and said bottom-most pocket having the longest depth.

7. The target of claim 1 wherein said frame cover is of a fabric, said fabric is chosen from the group consisting of flexible woven fabrics, flexible sheet materials, and flexible net materials.

8. The target of claim 1 wherein said pocket bottoms are generally horizontal and parallel to each other when said cover is in its expanded condition.

9. The target of claim 1 wherein two of said rods generally define said open front and are arcuate.

10. The target of claim 9 wherein the remaining rear support rod is arcuate, curving inwardly toward said front rods.

11. The target of claim 9 wherein said front rods and said front define an open front plane.

12. The target of claim 1 wherein said frame comprises two front rods and one rear rod.

13. The target of claim 1 wherein said rods each comprise a plurality of tubular rod segments and a tubular ferrule between each adjacent pair of rod segments assembled on a resilient cord connecting said rod segments and ferrules into a unitary rod structure, said cord having a non-expanded length shorter than the length of said rod and ferrules.

14. The target of claim 1 wherein said target sides and pocket bottoms are generally triangular in shape.

15. The target of claim 1 wherein each of said sides have a tubular portion formed along peripheral edge thereof, one of said rods being positioned in said tube, said tubes defining said open front of said target.

16. The target of claim 15 wherein a second tube is formed in said cover back, one of said rods being positioned in said second tube, said rod in said second tube being resiliently deformed from an at-rest position so as to hold said cover back taut with said pocket bottoms spaced apart and generally parallel and generally horizontal.

17. The target of claim 16 wherein a plurality of spaced apart tubular tabs define said second tube.

18. The target of claim 16 wherein said second tube is continuous essentially the entire length of said side.

19. The target of claim 16 wherein said tube is defined by a plurality of spaced apart clips.

20. The target of claim 19 wherein there being approximately the same number of clips as there are pockets, said clips being attached to said cover adjacent said pocket bottoms.

21. The target of claim 16 wherein said cover is attached to the bottom of each of said rods by a pin positioned in said rods, said pin being connected to said cover.

22. The target of claim 1 wherein each of said pockets has a capacity of several saucers.

23. The target of claim 1 wherein said pocket sides, top and bottom are each resilient whereby saucers impacting thereon lose velocity and drop gravitationally onto said pocket bottoms.

24. The target of claim 1 wherein said cover is of porous fabric material having a plurality of spaced apart openings therein.

25. The target of claim 24 wherein said fabric is net fabric.

26. The target of claim 1 wherein there are at least three pockets including a top pocket and a bottom pocket and a pocket therebetween, said pockets each having associated therewith a score, said score for the top pocket being the largest and said score for the bottom pocket being the smallest, said score for the pockets between said top and bottom pockets being sequenced between said top and bottom scores.

27. The target of claim 1 wherein said plurality of pockets having an upper-most pocket and a bottom-most pocket, said upper-most pocket having the shortest depth and said bottom-most pocket having the longest depth, each of said pockets having a front opening, said upper-most pocket having the smallest opening, said bottom-most pocket having the largest opening, said pocket openings between said upper-most and bottom-most pockets being sequentially sized between the size of said upper-most and bottom-most pockets.

28. The target of claim 1 wherein said plurality of pockets having a top pocket, said pocket bottoms being generally triangular in shape, said opening of said top pocket being generally triangular in shape, said pocket openings of said pockets other than said top pocket being generally frustro-triangular in shape.

29. The target of claim 1 wherein said bottom ends of said rods may be positioned in corresponding openings in a base, said base being of a rigid material having a density being chosen from the group of base materials consisting of materials having densities lighter than water and heavier than water.

30. A target comprising a frame, and a frame cover, said frame cover being supported on said frame, said cover having an open front and a closed back, said open front being divided into a plurality of front openings of spaced apart target pockets, each of said pockets having a bottom, a front opening, and a closed top, and closed sides, said pockets extending rearwardly of said opened front, said pocket openings being larger than the diameter of a throwing saucer in the horizontal direction whereby a game may be played by players throwing saucers at said target and accumulating a score from a plurality of scores associated with each saucer landing in the respective pockets of said target each of which is a function of the skill required of throwing a saucer into the respective pockets, said pocket openings generally having the same vertical height and different widths, said pocket widths ranging from an upper-most pocket having the narrowest width and a bottom-most pocket having the largest width.

* * * * *